US011534792B2

(12) United States Patent
Schlichtenbrede et al.

(10) Patent No.: US 11,534,792 B2
(45) Date of Patent: Dec. 27, 2022

(54) METHOD FOR CONTROLLING THE AMOUNT OF AN ADHESIVE TO BE APPLIED TO A SUBSTRATE

(71) Applicant: KHS GmbH, Dortmund (DE)

(72) Inventors: Christian Schlichtenbrede, Kleve (DE); Joachim Brzoska, Bochum (DE)

(73) Assignee: KHS GmbH, Dortmund (DE)

( * ) Notice: Subject to any disclaimer, the term of this patent is extended or adjusted under 35 U.S.C. 154(b) by 450 days.

(21) Appl. No.: 16/634,312

(22) PCT Filed: Jul. 20, 2018

(86) PCT No.: PCT/EP2018/069706
§ 371 (c)(1),
(2) Date: Jan. 27, 2020

(87) PCT Pub. No.: WO2019/037970
PCT Pub. Date: Feb. 28, 2019

(65) Prior Publication Data

US 2020/0230639 A1 Jul. 23, 2020

(30) Foreign Application Priority Data

Aug. 24, 2017 (DE) ..... 10 2017 119 439.8

(51) Int. Cl.

| | |
|---|---|
| ***B05C 11/10*** | (2006.01) |
| ***B65C 9/22*** | (2006.01) |
| ***B05C 1/08*** | (2006.01) |
| *B65C 9/40* | (2006.01) |
| *B65C 9/00* | (2006.01) |

(52) U.S. Cl.
CPC ..... *B05C 11/1042* (2013.01); *B05C 1/0873* (2013.01); *B65C 9/22* (2013.01); *B05C 1/0813* (2013.01); *B65C 9/40* (2013.01); *B65C 2009/0075* (2013.01)

(58) Field of Classification Search
None
See application file for complete search history.

(56) References Cited

U.S. PATENT DOCUMENTS 3,408,008 A * 10/1968 Cocks ..... B05C 11/1042 219/230
4,822,647 A * 4/1989 Nozaki ..... B05C 11/10 427/427.2

(Continued)

FOREIGN PATENT DOCUMENTS

CN 101806763 A 8/2010
CN 103472094 A 12/2013

(Continued)

OTHER PUBLICATIONS

First Office Action of the corresponding CN Application No. 20180056023.0 (Year: 2021).*

*Primary Examiner* — Jethro M. Pence
(74) *Attorney, Agent, or Firm* — Occhiuti & Rohlicek LLP

(57) ABSTRACT

Controlling application of adhesive on a substrate includes using a gas sensor, obtaining a first sensor signal. The first sensor signal indicates a partial pressure of a gas that arises from a constituent of the adhesive. Based at least in part on this partial pressure, the controller either controls an applicator's delivery of the adhesive to a substrate or causes an error signal indicative of the adhesive's unsuitability for adhesion.

24 Claims, 3 Drawing Sheets

(56) References Cited

U.S. PATENT DOCUMENTS 4,830,219 A * 5/1989 Siemann ..... B29B 7/726 264/40.7
4,848,657 A * 7/1989 Hashimoto ..... B05B 12/085 239/69
4,987,854 A * 1/1991 Hall ..... B05B 12/085 239/296
5,380,366 A * 1/1995 Becker ..... B05C 5/02 118/712
5,876,502 A * 3/1999 Sugimura ..... B31B 50/624 118/712
6,197,115 B1 * 3/2001 Barrey ..... B05C 11/1013 118/679
6,809,294 B2 * 10/2004 Velinsky ..... B05C 11/1042 404/107
7,112,246 B2 * 9/2006 Schucker ..... B25J 9/1684 118/713
7,214,907 B2 * 5/2007 Velinsky ..... B05C 5/02 404/107
9,574,714 B2 * 2/2017 Bondeson ..... F17D 3/00
9,731,486 B2 * 8/2017 Clark ..... B05C 5/001
9,889,996 B2 * 2/2018 Bondeson ..... B65G 53/66
10,201,827 B2 * 2/2019 Qu ..... B05C 11/1002
10,722,964 B2 * 7/2020 Fukakusa ..... B05C 11/101
10,974,954 B2 * 4/2021 Scheugenpflug ..... B67D 7/645
2005/0048196 A1 * 3/2005 Yanagita ..... B05B 12/085 427/421.1
2009/0104343 A1 * 4/2009 Espenschied ..... H05K 3/0091 427/9
2009/0285983 A1 * 11/2009 Baldauf ..... C09J 5/00 118/697
2010/0279127 A1 * 11/2010 Ukai ..... B05C 5/0254 222/251
2012/0095588 A1 * 4/2012 Barkmann ..... B05C 11/1007 118/667
2014/0311404 A1 10/2014 Eichhammer
2017/0120280 A1 * 5/2017 Hong ..... B05B 9/0403
2018/0117622 A1 * 5/2018 Estelle ..... B05C 11/1002

FOREIGN PATENT DOCUMENTS

EP 0259689 9/2010
EP 2233276 1/2011
EP 2269910 1/2011
WO WO 2017/101894 6/2017

* cited by examiner

METHOD FOR CONTROLLING THE AMOUNT OF AN ADHESIVE TO BE APPLIED TO A SUBSTRATE

RELATED APPLICATIONS

This application is the national stage under 35 USC 371 of international application PCT/EP2018/069706, filed on Jul. 20, 2018, which claims the benefit of the Aug. 24, 2017 priority date of German application DE 10-2017-119-439.8, the contents of which are herein incorporated by reference.

BACKGROUND

In the packaging industry, it is often necessary to apply adhesive. For example, it may be necessary to apply adhesive to a package, to a container, or to a label. It is therefore useful to control the manner in which adhesive is applied. In particular, it is useful to control the amount of adhesive to be applied.

SUMMARY

An object of the invention is to provide a method and device that takes account of the properties of the adhesive when determining how much adhesive to apply.

The invention is based on a method for controlling and monitoring an adhesive that an applicator, such as a sprayer, is to apply to a substrate. Examples include those in which one or more of the quantity, temperature, and flow speed.

The method can be used, for example, for applying adhesive used on labels to be put on containers or packages as well as for applying adhesive for mutual adhesive bonding of containers to form multipacks of containers, including multipacks four, six, or eight containers.

According to the invention, the presence, and in particular the concentration or the partial pressure, of a constituent substance of the adhesive, such as a binding agent, a solvent, or an additive, is measured with at least one gas sensor, and the application unit, or "applicator," is controlled depending on a sensor signal from the gas sensor. The terms "partial pressure" and "concentration" are to be used synonymously hereinafter. Ideally, an additive that is detected is a secondary substance delivered to the adhesive, such as a perfume or a substance that imparts an aroma. Ideally, this secondary substance has no functional property for the adhesive or the adhesion process.

Accordingly, hereinafter the term "solvent" is also always to be understood as being such a secondary substance. In this way it can be determined, for example, whether the solvent or binding agent content of the adhesive has decreased too much in the course of usage, such that there arises the risk of a satisfactory adhesive result no longer being obtainable. In this case a gas sensor identifies a decrease in the partial pressure of the solvent and/or binding agent as a result of observing a decrease in that gas' partial pressure. The application unit can therefore, for example, be stopped before reaching a reference value or limit value, if, due to the reduced content of solvent and/or binding agent, no further satisfactory adhesive result is to be anticipated. Conversely, it is also possible for the delivery of a binding agent and/or solvent to be controlled based on a sensor signal, which again delivers the highly volatile components to the adhesive, such that it remains constant over time in its composition, and therefore constant in its adhesive quality. In this way, an aging of the adhesive due to the vaporization or evaporation of highly volatile constituent is counteracted. It is therefore possible by way of the invention for the property, i.e., the composition of the adhesive itself, to be monitored as part of controlling of the application unit.

It is also possible that, by way of the evaporation behavior, i.e. the partial pressure change of the secondary substance, for determined whether the adhesive has aged and may need to be replaced. Accordingly, it is then possible for a warning message to be displayed on a display of the system or device, such as a labelling device or container-packing station with hot-adhesive points, that the adhesive should be replaced. As an alternative, the system can also be stopped, operated at another capacity, or operated with a higher glue application, in order to compensate for the deterioration in the glue's quality.

It would therefore be possible, within the framework of the control arrangement by means of the sensor signal of the gas sensor, for messages to be issued to the control device of the system and/or for the system itself to be controlled, for example to not start or to be stopped.

Such an application unit is, for example, a spray application unit with a spray head as an application unit, which sprays the adhesive onto the container or onto a label, or a hot adhesive unit, with at least one application opening, as an application unit, which applies a drop of a hot adhesive onto a container in order to connect it to other containers. It may also involve a surrounding packaging, such as a carton or bottle carrier, which is to be provided with a label. The adhesive can, in this situation, be applied either onto the labels, onto the containers or packaging, and/or onto points between the containers.

The invention makes it possible not only to check on the composition of the adhesive, but also to check on whether the correct adhesive is being used for a specific purpose. In this way, for example, different adhesives can be used for different purposes. If an incorrect adhesive is used for a specific purpose, this can lead to unsatisfactory adhesive results. Accordingly, by detecting the partial pressure of at least one component of the adhesive, in particular of a secondary substance, one can immediately identify whether the correct adhesive for the specified adhesion purpose has been introduced into the adhesive container.

If it should transpire on the basis of the sensor signal (i.e. the partial pressure, for example, of the secondary substance), that this is an incorrect adhesive, then, for example, the application unit will simply not be started at all. It is therefore possible, in an advantageous further embodiment of the invention, that a start of the application unit is only permitted if the partial pressure of at least one content substance of the adhesive lies in a permissible value range. It is always possible, additionally or alternatively to the controlling of the application unit, for an error signal to be issued, and/or for corresponding data to be stored in a suitable manner, which the installation control system, or a person entrusted with the control, can then use in any desired manner, for example to stop or reduce the capacity of the system, and to check on the adhesive production.

The delivery of the non-functional secondary substances referred to heretofore to the adhesive has the great advantage that these can be developed and used in their utilization purpose and with regard to their detection entirely independently of the adhesive. In this way, for example, a secondary substance can be very highly volatile, and very rapidly no longer be detectable after the evaporation of an adhesive, if, for example, the purpose of use is solely to ensure that only a permissible adhesive is filled into an installation or system. The missing partial pressure peak in the temporal connection with the change in the filling level could therefore lead, for example, to an error message, the throttling back of the capacity of the system, or to the system being switched off.

Ideally, the secondary substance is delivered to the adhesive after the production of the adhesive and before the specific use, into or for an application unit. This can be carried out in particular by known mixing processes and/or by spraying the adhesive with the secondary substance. In this situation, as has been indicated heretofore, the term "adhesive" is understood to mean a fully functional adhesive, for which the secondary substance has no, or essentially no, significance with regard to the actual adhesive function.

The application unit usually comprises an adhesive container, into which the adhesive which is to be applied is filled, an adhesive delivery unit from the adhesive container to the application unit, and the application unit itself, such as a scraper blade, a spray head with spray nozzles, or a drop application unit. The gas sensor is arranged in the region of one of these components. It is possible that the adhesive is delivered by way of a larger external feed container or tank, or is stacked there. In this case, the application unit does not comprise its own adhesive container, but only the adhesive delivery device, whereby the gas sensor is then arranged in the region of the adhesive delivery device or of the application unit, or possibly in a suitable gas sensor chamber provided there.

In particular, the gas sensor can be arranged directly at and/or above the application head for the adhesive. In the event of such an arrangement, due to the potentially highly changeable gas flow and mixing conditions, it is frequently possible only for a yes/no indication of the gas content substances being sought.

As the gas sensor, use is preferably made of a gas chromatographic or olfactometric operating sensor, which in particular allows for an assessment of the solvent content and/or of the binding agent content in the adhesive. In this situation, however, all other conceivable gas sensors can also be used, such as sensors operating in accordance with the principle of proton exchange reaction mass spectrometry. The gas sensor in conjunction with the analysis and evaluation unit will in particular detect the gas content substances, depending on the presence or absence of at least one type of substance and/or the concentration of the at least one substance type.

In an advantageous further embodiment of the invention, the application unit comprises a spraying device and the strength of the spray jet is adjusted based on the sensor signal. In this way, the adhesive can be adjusted to an optimum operational value by taking account of the gas partial pressure of the content substance of the adhesive, which then allows for an optimum adhesive capacity by taking account of the property of the adhesive and possibly of the binding agent content and/or the solvent content of the adhesive.

The application unit is preferably configured in another design than as a melt adhesive application unit, which is used, for example, for applying points of adhesive. The points of adhesive at the outer circumference of, for example, PET bottles, allows for these to be connected to one another without surrounding shrink films or plastic bands. Due to the gas sensor monitoring of the property of the adhesive, for example of the solvent and/or binding agent content, it can be ensured that the adhesive properties of the adhesive are optimized at all times.

In a further embodiment of the invention, the sensor signal, or a signal derived from it, is compared with a reference value, and an error message is issued if the reference value is reached or exceeded or undercut. If, for example, the solvent content of the adhesive is checked by the gas sensor, it may transpire that, due to the higher gas pressure of the solvent, this is gradually evaporating from the adhesive, with the result that its content is steadily decreasing. The partial pressure for the solvent can therefore be constantly be monitored by the gas sensor, and if a lower limit value for the solvent content is undercut, then either a system fault message can be issued or a correction message issued, which then leads to a solvent and/or binding agent delivery device being switched on, which again delivers solvent and/or binding agent to the adhesive, in order to maintain the quality of the adhesive. It is of course possible, as a dependency of the sensor signal, for a stirring or mixing device to be actuated, which then leads to the added solvent and/or binding agent to be well stirred into the adhesive present in the adhesive container.

In this case it is advantageous if a quantity sensor is provided for the quantity of the adhesive present in the adhesive container, such that the control system for the application unit can calculate, from the quantity of the adhesive still present in the adhesive container, the quantity of solvent and/or binding agent which is to be delivered, from the gas partial pressure and from the quantity of adhesive present in the adhesive container. This system can therefore run automatically and contribute to the highly volatile components of the adhesive, such as solvents and/or binding agents, always remain at a certain desired reference level.

The gas sensor is preferably designed so as to measure different content substances of the adhesive. As an alternative, it is also possible for a plurality of different gas sensors to be provided for the measurement of the different content substances, for example a gas sensor for the partial pressure of an adhesive basic substance, a gas sensor for the partial pressure of a binding agent, and a third gas sensor for the adhesive solvent, if the measured composition of the content substances deviates from a reference composition. With this error signal it is possible to show on a display, for example, which components deviate from the reference composition, such that a service technician is then in a position to top up the corresponding shortfall components into the adhesive container. This can also take place automatically if the corresponding delivery devices for the different content substances are actuated by the different gas sensors or by the measured values for the different content substances, and then automatically deliver in the correct quantity the components measured as shortfall according to the measured signals. It is also advantageous for this purpose if a quantity sensor is provided for the adhesive container, which determines the quantity of the adhesive present in the adhesive container. This can be a weight sensor, a volume sensor, or an optical sensor. By means of the invention it is therefore possible for the composition of the different content substances of the adhesive to be monitored, and even corrected if appropriate. In principle it is possible, by way of the gas sensor(s) for different components, for the adhesive to be investigated for its chemical composition, i.e. not only for its solvent and binding agent content, but also, for example, for its chemical substances which are effective with regard to technical adhesive properties.

In an advantageous further embodiment of the invention, the sensor signal(s) and/or a control value derived from the sensor signal is/are detected over time, and an error procedure is carried out if the time derivation of the control values falls below a limit value. It is possible, for example, that the solvent partial pressure of the adhesive decreases over the period of use, because the solvent, due to its higher partial pressure, is the first to evaporate from the adhesive. This leads to the intensity course of the sensor signal decreasing over time. The derivation of the measured intensity over time can therefore be formed, and this value can be compared with a limit value. In this way it is possible to foresee when a specific minimum partial pressure will be reached from which point the adhesive will no longer function satisfactorily. Conversely, by knowing the derivation and the minimum value, a delivery device for the corresponding components can be switched on, which delivers the corresponding components either constantly or in batches, in order to maintain them in the adhesive at a certain reference level.

This would therefore make it possible to identify substantial or too rapid ageing, occurring, for example, due to excessively great or excessively long lasting thermal or mechanical loading of the adhesive, such that the adhesive quality no longer corresponds to the reference values. In this way it is therefore also possible that, with the use of the correct adhesive, an operation of the system can be avoided which deviates from ideal value or reference values, or that any deviation can be made evident.

The invention likewise relates to a device for the application of adhesive onto a substrate, in particular a label, a container, such as a bottle, a can, a keg, or a carton. The device comprises an application unit for the adhesive onto the substrate, if appropriate an adhesive container, and/or an adhesive delivery device for the adhesive which is to be applied, for delivery to the application unit, wherein the quantity to be applied by the application unit, the temperature, and/or the flow speed of the adhesive can be controlled by a control device. According to the invention, the device comprises, in particular in the adhesive container and/or in the adhesive delivery device, a gas sensor, which is designed to detect the partial pressure of at least one content substance contained in the adhesive, wherein the gas sensor is connected on the output side to the control device, and the control device is designed such as to control the application unit as a dependency of the sensor signal from the gas sensor.

With regard to the advantages and properties of this device, reference is made to the description of the method referred to heretofore. This device allows for the measurement of the gas partial pressure of at least one content substance of an adhesive, and for the control of the application unit depending on the sensor signal, i.e. of the gas partial pressure of the corresponding content substance. In this way it can be ensured that the properties of the adhesive are monitored over time and advantageously maintained. In this sense, the proportion of at least one component of the adhesive, such as the solvent, for example, can be monitored, and it can be ensured that the gas partial pressure of the solvent, i.e. its proportion in the adhesive, does not fall below a specific minimum value.

In this situation, a substantial ageing could occur due to excessive thermal or mechanical loading of the adhesive, such that the quality of the adhesive no longer corresponds to the reference values.

If this is the situation, then either the application unit can be stopped, or a delivery device can already be switched on beforehand, as a dependency of the sensor signal, which ensures that the highly volatile components of the adhesive can be topped up rapidly. This delivery can be made continuously or in batches. In this way, by means of the invention, the quality of the adhesive can be ensured over the entire duration of the process.

By means of this device it is likewise possible to monitor whether the correct adhesive is being used for a desired adhesive process.

Preferably, the gas sensor is designed to detect different gas content substances of the adhesive, and their concentration. Instead of this, it is also possible for different gas sensors to be used for the different gas content substances. In this way, the composition of several components of the adhesive can be monitored in relation to a reference value. In particular, this also makes the identification of the adhesive possible.

The device preferably comprises a delivery circuit, which includes the adhesive container and/or the adhesive delivery device, as well as the gas sensor, which is arranged in the supply circuit. In this way it can be ensured that the measurement result from the gas sensor is not falsified by external environmental influences.

The device preferably contains at least one second sensor, which measures at least one of the following parameters: Temperature of the adhesive, filling level of the adhesive in the adhesive container, viscosity and/or flow speed of the adhesive being delivered. As a result of the additional measurement of these parameters and the common interpretation and evaluation of the data, the quality of the adhesive can be monitored and ensured over the duration of the process run. The consideration of the temperature even allows for the use of different solvent contents at different temperatures, such that an adhesive result is attained which is optimum for the corresponding predominant temperature. The detection of the filling level makes it possible, in the event of individual components of the adhesive being topped up, for the quantity of adhesive still present in the adhesive container to be detected, and for the missing or shortfall components to be metered in with optimum results. By way of the viscosity, a further important property of the adhesive can be detected, and this can be constantly optimized, for example by the addition of solvent and/or binding agent.

The device preferably comprises a gas suction device and/or an underpressure-generating device in the region of the adhesive container and/or the adhesive delivery device and/or the application unit. In this way it can be ensured that the highly volatile components of the adhesive do not pass into the environment and lead to any health hazards.

The device is preferably a labeling machine for the labeling of containers, such as, for example, bottles, cans, or kegs, or a machine for connecting a plurality of containers to form a container pack.

Preferably, two adhesive sensors are provided for the temperature and/or the viscosity of the adhesive, and the control device is designed such as to control a heating device and/or a conveying device for the adhesive, such as an adhesive conveying pump, as a dependency of the adhesive sensors. In this way it can be ensured, for example, that the viscosity and/or the temperature of the adhesive is/are always within a certain desired reference range.

The different embodiments described heretofore of the method and device can be combined within one another as well as with one another.

The following expressions are used as synonyms: sensor signal and output signal; delivery and delivery device; and regulating valve and setting valve.

BRIEF DESCRIPTION OF THE DRAWINGS

The invention is described hereinafter by way of example, on the basis of the schematic drawings in which.

DETAILED DESCRIPTION

Figure 1:
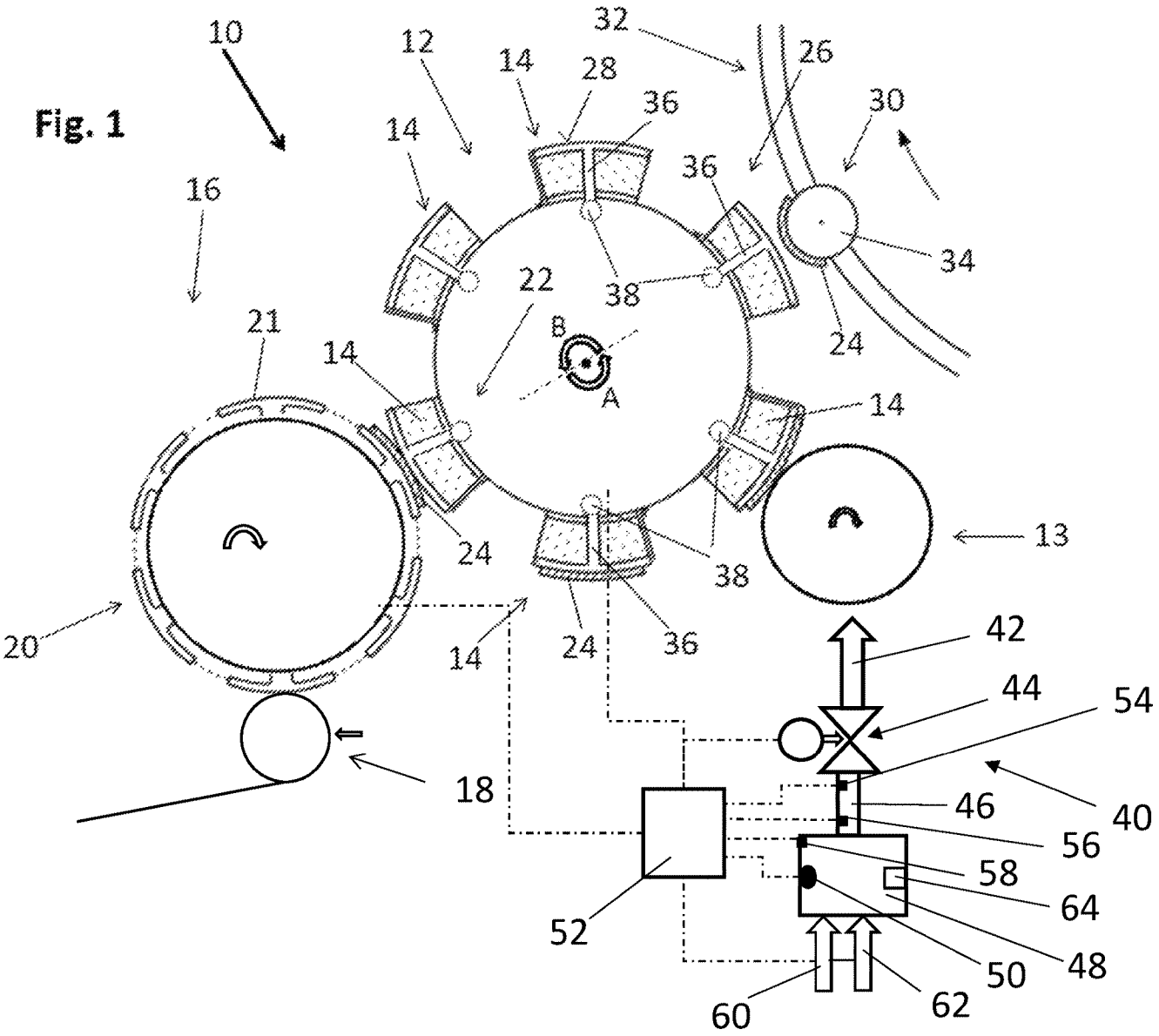
FIG. 1 is a view from above onto a labeling machine.

FIG. 1 shows a labeling machine 10 having a vacuum drum 12 that rotates about an axis-of-rotation. The labeling machine 10 also includes a label-delivery device 16 that includes a cutting roller 18 and a transfer drum 20.

The vacuum drum 12 has six receptors 14. The receptors 14 are equally spaced from each other around the drum's circumference. During the course of the vacuum drum's rotation, each receptor 14 passes through a first sector A and a second sector B, each of which corresponds to a range of angles. In some embodiments, a receptor 14 is able to move radially inward or outward.

As the vacuum drum 12 rotates, it brings receptors 14 to a reception region 22. In operation, while a receptor 14 is in the reception region 22, a label 24 is taken over from a label receiver 21 of the transfer drum 20 onto that receptor 14.

As the vacuum drum 12 continues to rotate, it brings the receptors 14 to a handover region 26. In operation, when the receptor 14 is in the handover region 26, a label 24 is moved from a receptor 14 onto a circumferential surface of a container 34 that is located at a transport point 30 of a transporter 23. of a container-handling device.

Each receptor 14 on the vacuum drum 12 has a suction surface 28 that faces radially outward to engage a label 24. The suction surface 28 connects to an associated vacuum chamber 36. The vacuum chamber 36 ends in a perforation 38 through a base plate. The base plates of the various receptors 14 extend along a circle that is concentric with the vacuum drum's axis-of-rotation. Each perforation 38 establishes communication between its corresponding vacuum chamber 36 and a vacuum source.

The labeling machine 10 further includes a glue roller 13 arranged along the first sector A between the reception region 22 and the handover region 26. The glue roller 13 rotates in a direction opposite that of the vacuum drum 12. As a result, rolling the glue roller 13 results in application of an even layer of glue to the rear side of a label 24 that is held on a receptor 14 as it rolls. This glue secures the label 24 to a container's circumference.

To promote contact between with the container 34, it is useful for the receptor 14 to move radially outward while in the handover region 36. However, in those embodiments that lack radially movable receptors 14, the vacuum drum 12 is arranged such that secure contact can be made even in the absence of such radial movement by the receptors 14.

The labeling machine 10 features an adhesive delivery system 36 that includes an adhesive reservoir 48, a controller 52, and a variety of sensors. These sensors include a gas sensor 50 to detect the presence of one or more adhesive gases, a temperature sensor 54 to measure the adhesive's temperature, a viscosity sensor 56 to measure the adhesive's viscosity, a filling-level sensor to measure the amount of adhesive remaining in the reservoir 48. The adhesive itself is, of course, not a gas. The term "adhesive gas" is used as a convenient way to refer to the gaseous form of various constituents of the adhesive, some of which may be volatile and hence have a tendency to evaporate, thus causing a measurable partial pressure.

The adhesive delivery system 36 also includes an applicator 40 in the region of a glue roller 13. The applicator 40 includes a sprayer 42 from which adhesive is launched from the adhesive delivery system 36 towards the substrate. A valve 44 upstream of the sprayer 42 regulates how much adhesive from the reservoir 48 to reach the sprayer 42.

In operation, the controller 52 controls the valve 44 to regulate the quantity of adhesive delivered to the applicator 40 to cause the sprayer 42 to spray an even distribution of adhesive onto the glue roller 13. The controller 52 controls the valve 44 based on one or more inputs from the sensors.

Some embodiments include devices for maintaining the condition of the adhesive. These include a solvent-agent delivery device 60, a binding-agent delivery device 62, and a stirrer, all of which are connected to the adhesive reservoir 48. A heater 64 in the adhesive reservoir 68 heats the adhesive as needed to maintain a target viscosity. In such embodiments, the controller 52 controls the solvent-agent delivery device 60, the binding-agent delivery device 62, and the heater 64 based on outputs from one or more of the aforementioned sensors.

In some embodiments, the gas sensor 50 measures a partial pressure of an adhesive gas. An example of such an adhesive gas is that associated with adhesive's solvent. The gas sensor 50 provides a signal indicative of this gas pressure to the controller 52, which then controls the valve 44. As a result, the controller 52 is able to control supply a particular quantity of adhesive based on a sensor signal from the gas sensor 50.

In some cases, the controller 52 will simply switch off the applicator 40 upon occurrence of a condition. Examples of such conditions include a signal from the gas sensor 50 that indicates a particularly low partial pressure of an adhesive gas. Such a low value may indicate that the adhesive is no longer capable of carrying out its function. In some cases, the adhesive gas is that which arises from evaporation of the adhesive's solvent. However, other gases can also be sensed.

In some embodiments, a signal from the viscosity sensor 56 or the temperature sensor 54 provides a basis for adjusting the quantity of adhesive to be delivered. In addition, the temperature sensor 54 provides a basis for controlling the heater 64 so as to maintain a suitable temperature for the adhesive. Since viscosity is often a function of temperature, the output of the viscosity sensor 56 also provides a basis for controlling the heater 64.

In some embodiments, the gas sensor 50 detects partial pressures of several species of adhesive gas. This permits an inference to be made concerning the nature or condition of the adhesive. From this, such inferences, it is possible to tell whether the adhesive is appropriate for the desired purpose.

It is also possible to infer from such measurements of multiple species, particularly when combined with measurements from the viscosity sensor 56, to determine whether certain constituents, such as solvents or binding agents, are missing or in otherwise short supply. In such embodiments, the controller 52 causes the solvent-delivery device 60 or the binding-agent delivery device 62 to top up the missing constituents as required to restore the adhesive to a reference state thereof.

Some embodiments include a filling-level sensor 58 that measures extent to which adhesive fills the adhesive container 48. Information from the filling-level sensor 58 is particularly useful for topping up the components of the adhesive. In particular, the information from the filling-level sensor 58 permits optimizing the quantity of solvents and binding agents that are delivered during the topping-up process.

Figure 2:
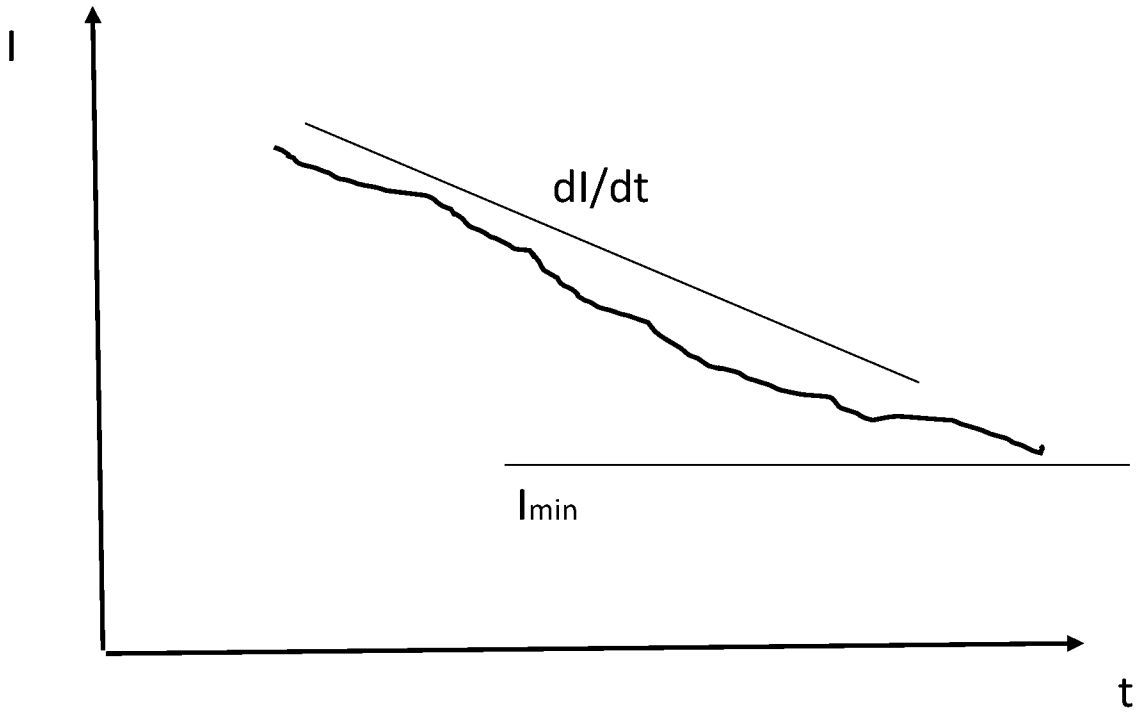
FIG. 2 shows measured solvent content of an adhesive over time.

FIG. 2 shows a sensor signal provided by the gas sensor 50 during the course of operation. In the illustrated example, the gas sensor 50 measures partial pressure of solvent that evaporates over time. The vertical axis "I," which represents "intensity," indicates that partial pressure is decreasing in an approximately linear fashion with a slope approximated by dI/dt. It is thus possible for the controller 52 to extrapolate and predict when the partial pressure of solvent will drop below a minimum permissible value, $I_{min}$, and to take steps accordingly.

In some embodiments, the controller 52 stops the applicator 40 before the partial pressure reaches this minimum value. In other embodiments, the controller 52 instructs either or both the solvent delivery device 60 or the binding agent delivery device 62 to take steps to correct the loss of solvent partial pressure by delivering respective amounts of binding agent or solvent. This permits the controller 52 to maintain a consistent quality of adhesive.

It is also possible to use the time evolution of partial pressure of gas from an adhesive to assess the condition of the adhesive during filling of the reservoir 48.

Figure 3:
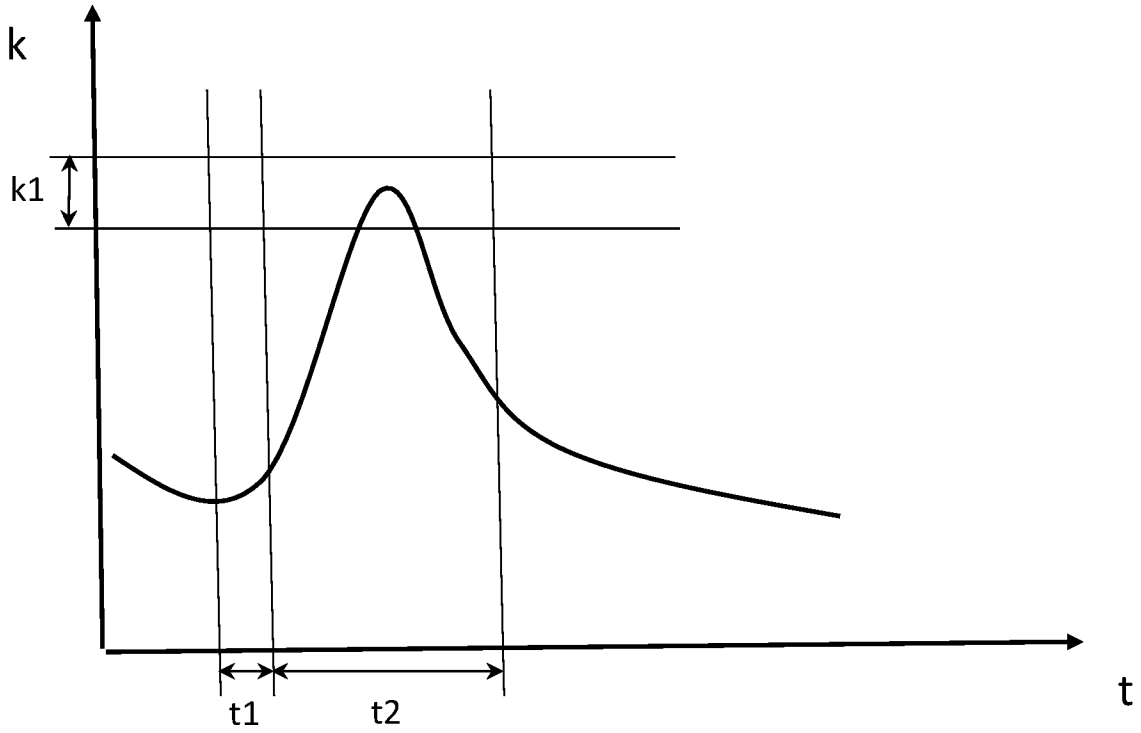
FIG. 3 shows measured solvent content of an adhesive over time in connection with a re-filling an adhesive container with adhesive.

FIG. 3 shows the expected evolution of partial pressure over time for a gas when filling the reservoir 48 with adhesive. The filling interval t1 is the time needed to fill the reservoir 48, the peak interval t2 is the duration of an anticipated peak in partial pressure, and intensity k1 represents a range of anticipated partial pressures that one might expect shortly after having filled the reservoir 48 with the adhesive.

The measured partial pressure can be that of the adhesive's solvent or of a secondary substance that has been introduced only for identification.

During the filling interval t1, the partial pressure is anticipated to rise sharply until it reaches the intensity range k1. If, on the basis of the sensor signal from the gas sensor 50, this peak is indeed measured in this range, the system is then disconnected. If, after filling, this peak has not been reached within the following peak interval t2 in the intensity range k1, then one can infer that the adhesive is unsuitable, either because it has aged or because it is an incorrect adhesive. Under these circumstances, a warning signal to be issued and/or the system is stopped or, if the system is not running, it is prevented from starting.

Some embodiments take account of temperature dependency. For example, with a higher temperature, a steeper decline in intensity over time would be expected in FIG. 2 and the anticipated peak interval t2 would differ in both in both temporal extent and location along the temporal axis and the anticipated intensity range k1 would differ in its location along the temporal axis and in its extent in along the intensity axis.

The adhesive-application system described herein has been described in connection with a labeling machine 10 that labels containers. However, it can also be used for labeling cartons or for applying adhesive used to bond container together into container packs. The adhesive-application system as described herein is also usable for applying adhesive in connection with folding and aligning cartons during carton packaging.

In the illustrated example, adhesive ultimately passes through a sprayer 42 before reaching the substrate. However, the principles described herein are independent of the choice of what actually applies the adhesive. Thus, the system described herein is usable with a device that applies adhesive points or other devices for surface application of adhesive.

In some embodiments, the adhesive delivery device 46 is a delivery pump that adjusts the delivery pressure of the adhesive and hence the pressure with which the sprayer 42 sprays the adhesive. The control device 52 then preferably controls the valve 44 and/or the delivery pump. However, it is also possible to use an adjustable delivery pump instead of a valve 44.

The invention is not restricted to the exemplary embodiment described heretofore, but can also be varied at will within the scope of protection of the following claims.

Having described the invention and a preferred embodiment thereof, what is new and secured by Letters Patent is:

1. A method comprising using an apparatus to apply an adhesive to a substrate, said apparatus comprising a controller, a gas sensor, an applicator, and an adhesive reservoir that contains said adhesive, wherein said applicator applies adhesive from said adhesive reservoir onto said substrate, wherein said gas sensor is configured to detect a partial pressure of an adhesive gas, said adhesive gas arising from a constituent of said adhesive, and wherein said controller is configured to receive a sensor signal from said gas sensor and to carry out an action selected from the group consisting of controlling said applicator based at least in part on said sensor signal and causing storage or display of an error signal, wherein using said apparatus comprises causing said controller to receive a first sensor signal from said gas sensor, said first sensor signal being indicative of a measurement of said partial pressure of said adhesive gas, based at least in part on said measurement of said partial pressure, causing said controller to carry out an action selected from the group consisting of controlling said applicator's delivery of said adhesive to said substrate and causing storage or display of an error signal indicative of said adhesive's unsuitability for adhesion.

2. An apparatus for applying an adhesive to a substrate, said apparatus comprising a controller, a gas sensor, an applicator, and an adhesive reservoir, wherein said applicator applies said adhesive from said adhesive reservoir onto said substrate wherein said gas sensor is configured to detect a partial pressure of an adhesive gas, said adhesive gas arising from a constituent of said adhesive, wherein said controller is configured to receive a sensor signal from said gas sensor and to carry out an action selected from the group consisting of controlling said applicator based at least in part on said sensor signal and causing storage or display of an error signal.

3. The apparatus of claim 2, further comprising a suction device disposed at an application region.

4. The apparatus of claim 2, further comprising an adhesive delivery device that delivers adhesive from said adhesive reservoir, wherein said gas sensor is disposed in said adhesive reservoir or in said adhesive delivery device.

5. The apparatus of claim 2, wherein said gas sensor is configured provide measurements of concentrations of different adhesive gases and wherein said controller takes action based at least in part on said concentrations of different adhesive gases.

6. The apparatus of claim 2, further comprising a delivery circuit that comprises an adhesive delivery device that draws adhesive from said adhesive reservoir, wherein said gas sensor is disposed along said delivery circuit.

7. The apparatus of claim 2, further comprising additional sensors, wherein said additional sensors measure a temperature of said adhesive, an extent to which said adhesive reservoir is filled with said adhesive, a viscosity of said adhesive as said adhesive is being delivered, and a flow speed of said adhesive as it is being delivered.

8. The apparatus of claim 2, further comprising a suction device that draws adhesive gas away from said adhesive reservoir or from an adhesive delivery device thereby reducing emission of said adhesive gas into the environment.

9. The apparatus of claim 2, further comprising a machine selected from the group consisting of a labeling machine and a machine for adhesively connecting containers so as to form container bundles, wherein said machine provides said substrate.

10. The apparatus of claim 2, further comprising a heater for controlling viscosity of said adhesive and a delivery pump for pumping said adhesive from said adhesive reservoir, and a valve for regulating flow of said adhesive.

11. The apparatus of claim 2, wherein said gas sensor is disposed at or above a glue roller.

12. The apparatus of claim 2, wherein said controller is configured to suppress said applicator's ability to apply said adhesive based on having determined, from said measurement received from said gas sensor, that said partial pressure is outside of a permissible range.

13. The apparatus of claim 2, wherein said gas sensor comprises an olfactometer.

14. The apparatus of claim 2, wherein said applicator comprises a sprayer and said controller is configured to adjust a spray of said sprayer in response to said measurement of said partial pressure received from said gas sensor.

15. The apparatus of claim 2, further comprising a melt adhesive in said adhesive reservoir.

16. The apparatus of claim 2, further comprising an adhesive delivery device for causing said adhesive to be in circulation and in communication with said applicator.

17. The apparatus of claim 2, wherein said controller is further configured to compare a reference partial pressure with a measurement of said partial pressure from said gas sensor and to causing display of said error signal in response to having determined that said measurement of partial pressure differs from said reference partial pressure.

18. The apparatus of claim 2, wherein said gas sensor is configured to make measurements of partial pressures of additional adhesive gases, wherein said controller is configured to receive said measurements, and wherein said controller is configured to store or display said error signal in response to having determined that said adhesive has a composition that deviates from a reference composition by having an incorrect constituent or by having a constituent at an incorrect concentration.

19. The apparatus of claim 2, wherein said controller is configured to receive said sensor signal as a result of having obtained a measurement of partial pressure that extends over time and wherein said controller is configured to cause storage or display of said error signal in response to detecting that, during said time, said measurement of partial pressure has exceeded a limit value.

20. The apparatus of claim 2, further comprising a filling-level sensor that provides a measurement of a fill level of said adhesive reservoir, wherein said controller is configured to carry out said action based at least in part on said measurement of said fill level.

21. The apparatus of claim 2, further comprising a binding agent delivery device that is configured to introduce a binding agent into said adhesive and a solvent delivery device that is configured to introduce a solvent into said adhesive.

22. The apparatus of claim 2, wherein said gas sensor is configured to provide a signal indicative of partial pressure of a substance that imparts an aroma to said adhesive.

23. The apparatus of claim 2, wherein said gas sensor is configured to provide a signal indicative of partial pressure of a substance that has been added to said adhesive following manufacture of said adhesive in order to perfume said adhesive.

24. The apparatus of claim 2, wherein said sensor signal is a first sensor signal and wherein said gas sensor is further configured to provide a second sensor signal to said controller, said second sensor signal being indicative of an additional measurement, said additional measurement being a measurement of a property selected from the group consisting of a temperature of said adhesive, an extent to which an adhesive reservoir is filled with said adhesive, a viscosity of said adhesive as it is being delivered, and a flow speed of said adhesive as it is being delivered, and wherein said controller is configured to select said action based at least in part on said first and second sensor signals, and wherein said error signal indicates said adhesive's unsuitability for adhesion.

* * * * *